US011029125B2

(12) United States Patent
Calvete

(10) Patent No.: US 11,029,125 B2
(45) Date of Patent: Jun. 8, 2021

(54) BREAK OPEN SYSTEM HAVING AN ADJUSTABLE, RELEASABLE FOREND STOCK

(71) Applicant: Ardesa, S.A., Zamudio-Vizcaya (ES)

(72) Inventor: Angel Calvete, Zamudio-Vizcaya (ES)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 16/864,266

(22) Filed: May 1, 2020

(65) Prior Publication Data

US 2020/0271412 A1 Aug. 27, 2020

Related U.S. Application Data

(62) Division of application No. 16/233,992, filed on Dec. 27, 2018, now Pat. No. 10,697,731.

(60) Provisional application No. 62/611,183, filed on Dec. 28, 2017.

(51) Int. Cl.
*F41C 23/16* (2006.01)
*F41A 3/58* (2006.01)

(52) U.S. Cl.
CPC ..... *F41C 23/16* (2013.01); *F41A 3/58* (2013.01)

(58) Field of Classification Search
CPC .... F41A 3/04; F41A 3/58; F41C 23/16; F41C 7/11
USPC ... 42/34, 71.01, 75.04, 106, 8, 75.02, 75.01, 42/40
See application file for complete search history.

(56) References Cited

U.S. PATENT DOCUMENTS

| | | | |
|---|---|---|---|
| 157,699 | A | 12/1874 | Scott |
| 210,523 | A | 12/1878 | Hackett |
| 235,881 | A | 12/1880 | King |
| 766,231 | A | 8/1904 | Elterich |
| 822,886 | A | 6/1906 | Elder |
| 865,357 | A | 9/1907 | Chadwick |
| 882,562 | A | 3/1908 | Hepburn |
| 1,795,111 | A | 3/1931 | Dygert et al. |
| 2,354,025 | A | 7/1944 | Johnson |
| 3,526,051 | A | 9/1970 | Greco et al. |
| 3,751,841 | A | 8/1973 | Nasypany |
| 4,282,671 | A | 8/1981 | Wood |
| 4,689,911 | A | 9/1987 | White |
| 4,964,232 | A | 10/1990 | Mainland |
| 6,829,858 | B2 | 12/2004 | Gablowski |
| 7,065,913 | B2 | 6/2006 | Lizarralde et al. |

(Continued)

*Primary Examiner* — Jonathan C Weber
(74) *Attorney, Agent, or Firm* — DeLio Peterson & Curcio LLC; Robert Curcio

(57) ABSTRACT

A forend stock for a break open firearm having a housing lug, the housing lug being attached into the lower side of the barrel assembly. A coupler is secured onto the housing lug. At the coupler end opposite the housing lug rod, there is a cylindrical area, and between the two coupler ends, another finished area forming an extended flange. The extended flange has a larger diameter than the cylindrical ends of the coupler. A latch bolt is secured to the forend stock by a cover plate. The latch bolt is topped at one of its ends with a sharp bevel. At its other end, it has a cylindrical post to support a pressure spring, and is held in a longitudinal channel or recess, and arranged such that a user can access an actuator knob for manual handling of the latch bolt. The cover plate assembly has an aperture which the ledges of an extended protrusion of the latch bolt fit within, defining the forward and backward travel limits that the bolt can go in a direction parallel to the axial direction of the barrel.

13 Claims, 11 Drawing Sheets

(56) References Cited

U.S. PATENT DOCUMENTS

| | | | |
|---|---|---|---|
| 7,316,092 | B2 | 1/2008 | DeLeeuw |
| 7,908,781 | B2 | 3/2011 | Laney et al. |
| 9,228,804 | B2 | 1/2016 | Syrengelas et al. |
| 9,546,844 | B2 | 1/2017 | Hall et al. |
| 2007/0089347 | A1 | 4/2007 | Webber et al. |
| 2016/0341518 | A1 | 11/2016 | Barfoot et al. |

Threaded Rod
Barrel Assembly
Housing Lug
Screw to attach Housing Lug
Inner threaded area
Coupler
Set screw
Knurled Bushing
Latch bolt
Cover Plate

BREAK OPEN SYSTEM HAVING AN ADJUSTABLE, RELEASABLE FOREND STOCK

BACKGROUND OF THE INVENTION

1. Field of the Invention

This invention is related to firearms such as rifles and shotguns, and more particularly, break action or break open firearms. Specifically, the invention relates to the attachment and removal of a forend stock.

2. Description of Related Art

A break action or break open firearm (swinging barrel gun) in general, and a break action muzzle loading firearm in particular, offers speed in the loading or reloading process. In the case of a muzzle loading firearm, once a charge of powder, wad, and bullet go down and seat in the barrel, with the flick of a switch or lever the barrel drops down and exposes the breech for priming. The break action design changes the center of gravity for the gun and allows for a longer barrel on a package that is still balanced.

Break action muzzleloaders use heavy built metal frames in most cases adding durability to the muzzleloaders action itself. The added weight also tends to break up some extra felt recoil.

In a break action gun, in order to disassemble the weapon and divide it, the forend stock and buttstock must be removed. The buttstock is a part of the firearm to which the barreled action and firing mechanism are attached. It is held against the shooter's shoulder when shooting the firearm. The buttstock transmits recoil into the shooter's shoulder. The forend stock is located on the underside of the barrel, and generally extends roughly half the length of the barrel. To achieve disassembly, the barrel is released and detached from the buttstock and receiver or rifle action, and from the forend stock.

Generally, a substantial hinge pin joins the two parts of the rifle or shotgun; the stock with its firing mechanism, and the forend stock and barrel assembly—which ultimately holds the round to be fired. In some cases the hinge pin may be easily removable, allowing the two portions of the weapon to be easily separated. In other cases the hinge will consist of a hook over a pin; releasing an auxiliary latch which allows the hinge to be unhooked. In this manner, guns of a certain quality come with a lever or a button that can engage and disengage the barrel/forend stock combination from the buttstock/receiver assembly, and a hook welded under the barrel which is shaped to be attached with the mechanism of the forend stock.

The aforementioned systems, however, are difficult to adjust, since most of them do not accommodate adjustable setting systems. Consequently, in the case of misalignment, such as by wear and/or tear, accuracy is compromised, and repair becomes complicated.

In some instances, in rifles and low and medium cost commercial shotguns, a screw is used to attach the forend stock to the barrel. This straight-forward solution tackles some of the problems of the coupling systems, and significantly reduces the cost, although it involves a serious drawback in that the screw requires the user to have a tool, e.g., a wrench, in order to tighten or loosen the screw. This tool must always be carried together with the weapon, bringing with it the risk of the tool being lost.

Additionally, even the screw itself could be lost, which would prevent being able to mount or dismount the assembly. In the case this procedure was needed to be performed in a remote hunting area, a mountainous or sparsely populated region, it becomes increasingly more difficult to manage.

It is also clear that much more time is required for this procedure than in the hook or button systems in which the user only needs to press a button or lever in order to perform these operations.

SUMMARY OF THE INVENTION

Bearing in mind the problems and deficiencies of the prior art, it is therefore an object of the present invention to provide a removable, releasable stock for a break open firearm.

It is another object of the present invention to provide an adjustable, attachable stock for a break open firearm.

Still other objects and advantages of the invention will in part be obvious and will in part be apparent from the specification.

The above and other objects, which will be apparent to those skilled in the art, are achieved in the present invention which is directed to a firearm having an adjustable, releasable forend stock comprising: a barrel assembly; a retainer mechanism including a housing lug, the housing lug being threadably attached on a first side to a lower side of the barrel assembly, the housing lug having a threaded rod projecting on a second side opposite the first side, towards the forend stock; a coupler threadably secured onto the housing lug threaded rod at a first end and having at a second end opposite the first end formed for insertion within a bushing fixed on the forend stock, the coupler including a cylindrical portion intermediate the coupler first and second ends, the cylindrical portion having an extended flange; and a latch bolt having a top surface and a beveled end, the latch bolt in slidable communication with the forend stock, and acted upon by a resilient component, such that the latch bolt secures the forend stock to the barrel assembly when in a locked position the latch bolt prohibits the coupler extended flange from movement.

In a second aspect, the present invention is directed to a break action firearm having an adjustable, removable forend stock comprising: a barrel assembly and a buttstock assembly having a receiver end for mating with the forend stock; a retention mechanism attached at one end to the barrel assembly, the retention mechanism including: a housing lug secured at a first end to the barrel assembly, the housing lug having at a second end a coupler; the coupler having an extended flange in slidable mechanical communication with a first end of a latch bolt upon movement of the forend stock towards the barrel assembly; the latch bolt in mechanical communication with a spring at a second end of the latch bolt, and slidable with respect to the forend stock in a direction towards the extended flange of the coupler, such that upon locking the forend stock to the barrel assembly, the latch bolt is under force by the spring to cover a top surface of the extended flange.

In a third aspect, the present invention is directed to a method of releasing a forend stock from a firearm having a barrel assembly, the method comprising: slidably moving an actuator knob, extending from an aperture through a bottom side of the forend stock, towards a breech end of the firearm, thereby releasing a latch bolt internal to the forend stock; rotating the forend stock away from the barrel assembly; and detaching the forend stock from the barrel assembly.

In a fourth aspect, the present invention is directed to a method of attaching a forend stock having a breech end and a muzzle or forward end to a firearm having a buttstock assembly and a barrel assembly, the method comprising: inserting the forend stock breech end into the buttstock assembly to form a pivot connection; rotating the forend stock towards the barrel assembly, such that upon rotation: a latch bolt within the forend stock, and in slidable communication with the forend stock, is acted upon by a coupler in mechanical communication with the barrel assembly; the latch bolt slides towards the forend stock breech end compressing a resilient component, which provides a retraction force to the latch bolt; and wherein upon rotation, the retraction force acts on the latch bolt to slide the latch bolt towards the muzzle of the forward end of the forend stock, the latch bolt securing the coupler.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-11 of the drawings in which like numerals refer to like features of the invention.

The invention described herein is a simple and inexpensive system that enables the operation of disassembling the forend stock of a rifle or a shotgun, and which may be employed for a number of different firearms, including but not limited to, break action rifles, and especially break action muzzleloader rifles.

Concerning the following descriptions, when reference is made to the assembled firearm, it is assumed that the firearm is horizontally directed and in shooting position, so that the fore part (forend stock) is on the barrel muzzle side of the firearm, the rear part is the side having the buttstock and receiver assembly, the lower portion or bottom portion is that portion directed towards the ground, and the upper portion or top portion is that portion directed towards the sky.

Figures 1A, 1B, 1C:
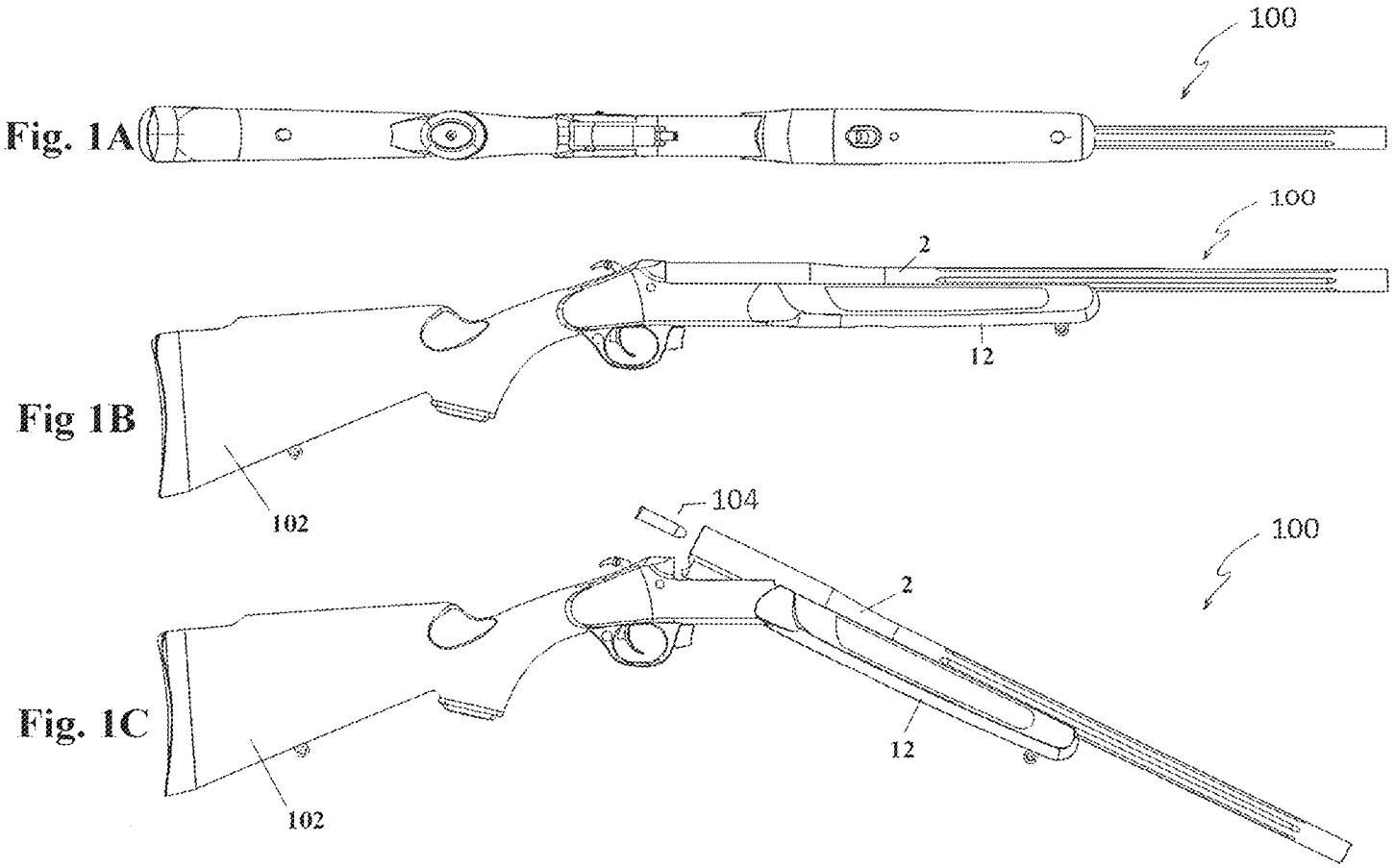
FIGS. 1A-1B depict a bottom and side view, respectively, of a closed break action barrel gun.
FIG. 1C depicts a side view of an open break action barrel gun in the loading and unloading position.

FIGS. 1A-1B depict a bottom and side view, respectively, of a closed break action barrel firearm 100, having a buttstock 102, a forend stock 12, and a barrel assembly 2.

FIG. 1C depicts a side view of the open break action barrel firearm 100 in the loading and unloading position, showing a cartridge 104 for insertion into the breech end of barrel 2.

Figure 2:
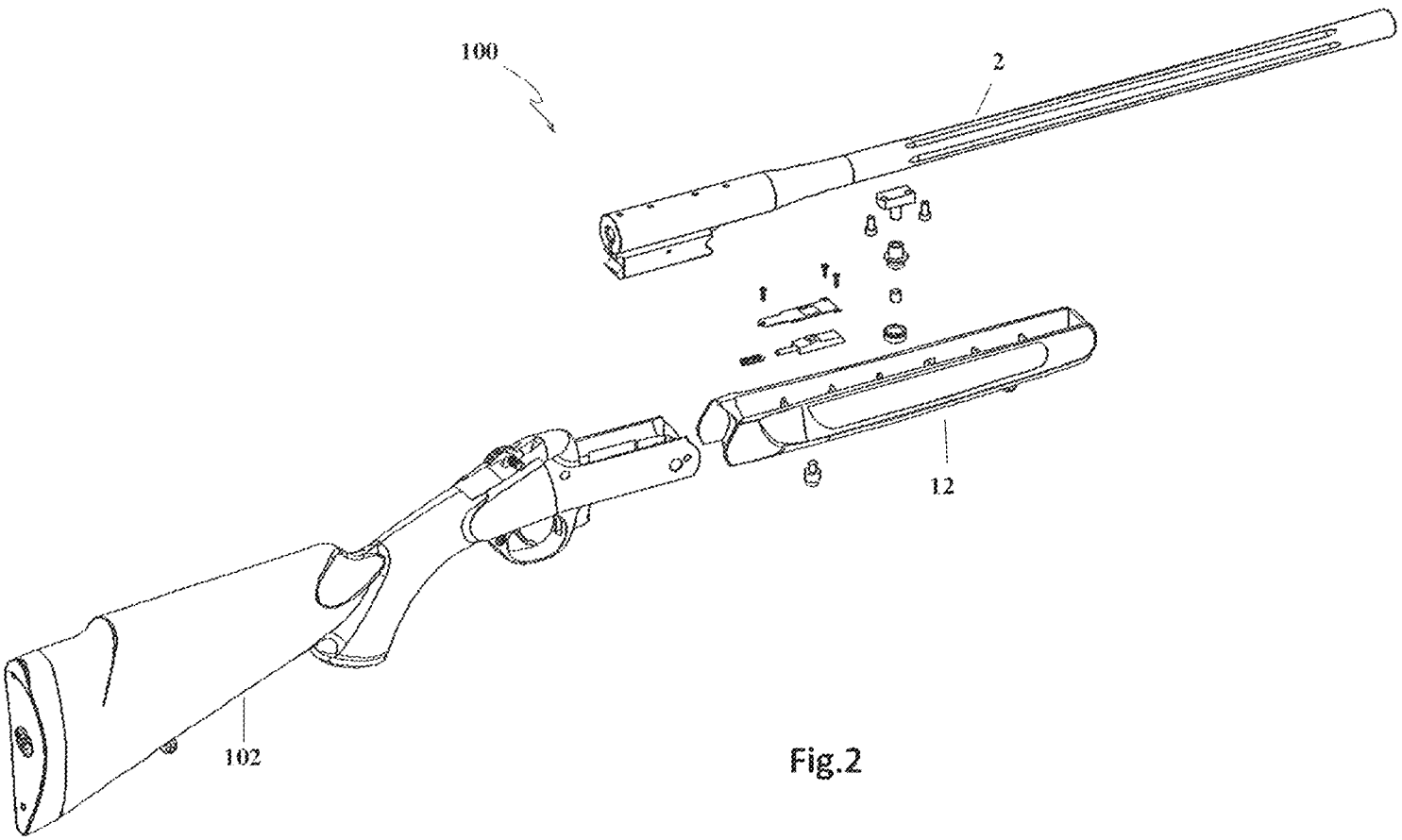
FIG. 2 depicts a general exploded view of the firearm of FIG. 1 showing the different components which make up the present invention.

FIG. 2 depicts a general exploded view of the firearm of FIG. 1 showing the relative positions of the different components for the forend stock assembly.

For assembly of a detached forend stock 12, utilizing the attachment scheme of the present invention, it is only necessary to position the forend stock 12 in its place, and press it to the barrel assembly 2 to secure it—advantageously, there is no need to employ additional operations.

Figure 3:
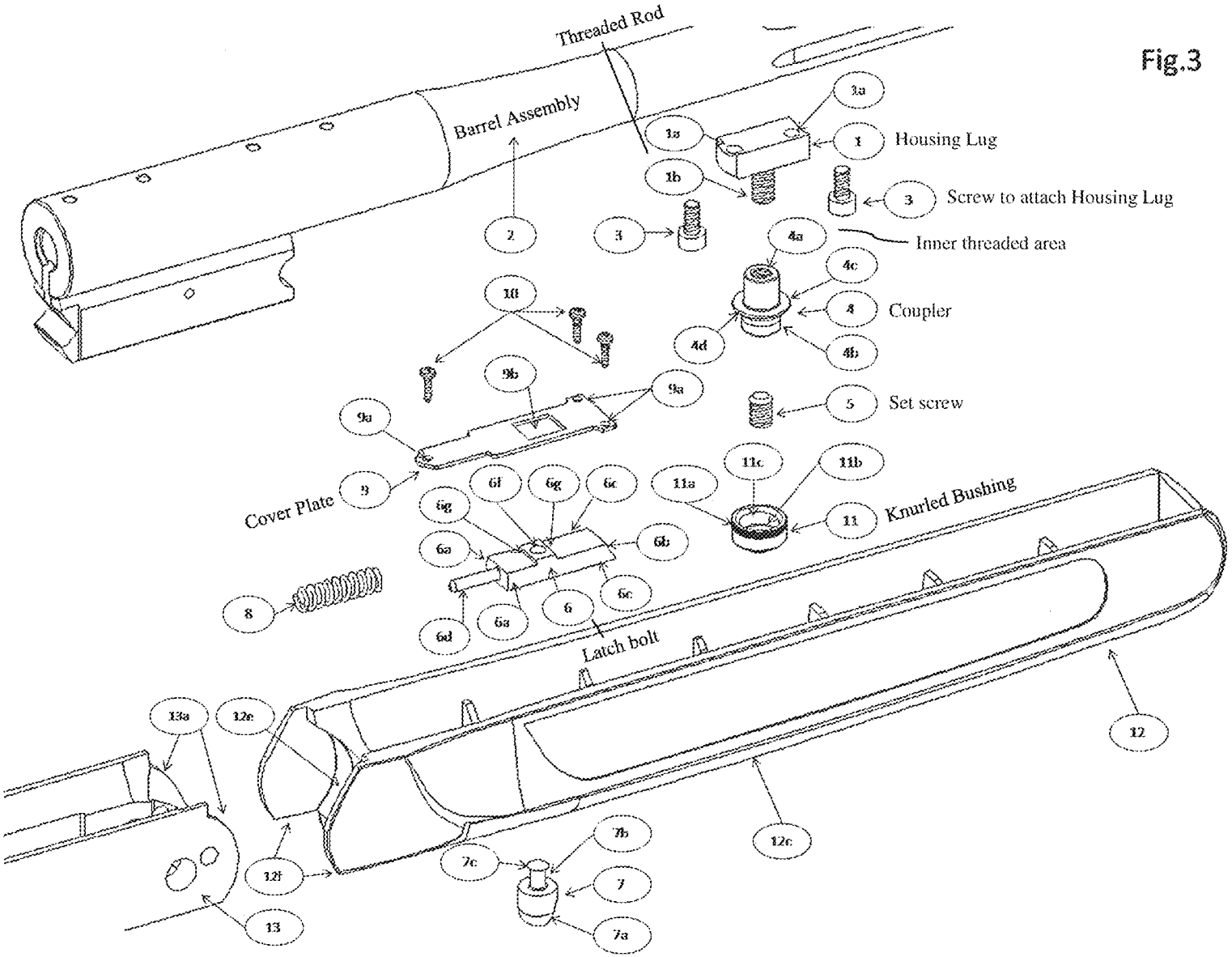
FIG. 3 is an exploded view of FIG. 2, depicting the components of the present invention.

Referring to FIG. 3, an attachment scheme of the present invention features a housing lug 1 having a threaded rod 1*b*. Housing lug 1 is threadably attached into the lower side of the barrel assembly 2 shown using two screws 3; however, any number of screws, or other secure attachment schemes may suffice. In this preferred embodiment, screws 3 are designed to pass through via the holes 1*a* in housing lug 1, and secure to the lower portion of the barrel assembly 2, which has complementary receiving threaded apertures (not shown).

A cylindrical coupling part or coupler 4 is threadably secured onto rod 1*b*, having an inner threaded area 4*a* which allows it to be coupled to the threaded portion of rod 1*b*. At the coupler end opposite threaded area 4*a*, there is a lower cylindrical, threaded area 4*b*, and between the two ends of coupler 4 is a finished area forming an extended disc portion 4*c* having an exposed edge. The extended disc portion 4*c* has a larger diameter than the cylindrical ends of coupler 4. In at least one embodiment, the extended disc portion 4*c* enjoys a transition radius 4*d* that decreases with axial length as the extended portion extends towards cylindrical, threaded area 4*b*.

In order to ensure the fixing of coupler 4 to the threaded rod 1*b* and not allow the mating combination to loosen, a locking screw 5, which is suitably fitted in the cylindrical threaded area 4*b* of coupler 4, puts pressure on the end of the rod 1*b* straining the union of these parts and preventing them from coming loose.

Figure 4:
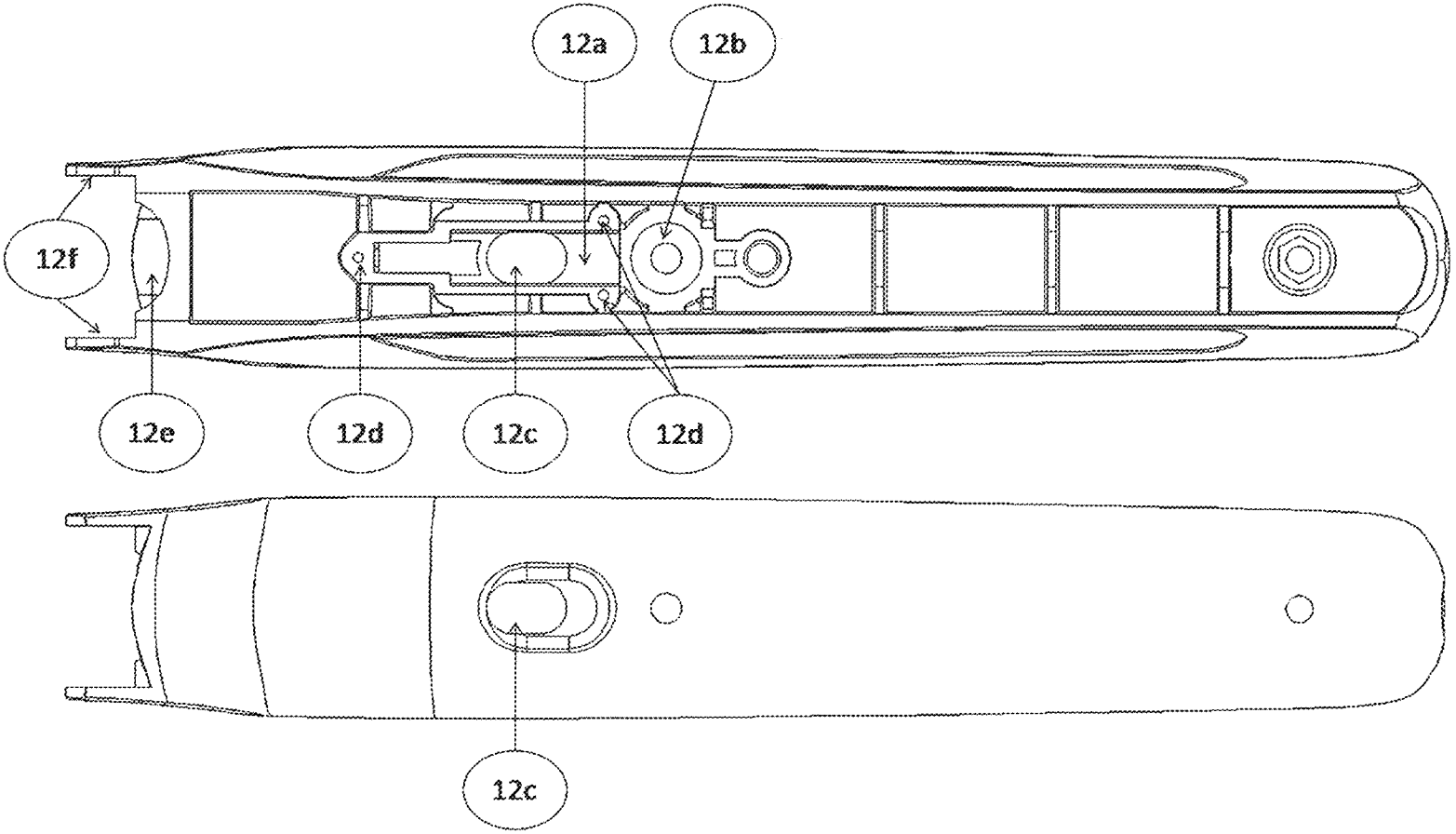
FIG. 4 depicts a view of the forend stock identifying the housings arranged to house the components identified in FIG. 3.

FIG. 4 depicts a top view of the forend stock 12 identifying the housing arrangement for housing the components identified in FIG. 3.

The forend stock 12 is preferably made of synthetic material (plastic); however, the present invention does not limit the forend stock to any particular type of material. Referring to FIGS. 3 & 4, inside the forend stock, the housings and needed features for the assembly and operation of the system are shown as arranged.

Viewing the inside of forend stock 12 is a dimensioned hole 12*b*, as depicted in FIG. 4, to hold the press-fit insertion of a bushing 11 (FIG. 3). Bushing 11 is designed to receive coupler 4.

Bushing 11 is a hollow cylindrical lining or sleeve which may be fixed by press-fitting into the cavity 12*b* of the forend stock 12, for which it features a knurling finish 11*a*. As noted previously, bushing 11 receives coupler 4, and particularly prevents further extension of set screw 5.

This hollow bushing is shaped so that coupler 4 may fit in the hollow portion, the cylindrical area 4*b* having a diameter that fits without noticeable clearances in the inner side of the bushing 11*b*. In order to facilitate access into this hole, the edge of the bushing 11*c* is rounded.

Proximate bushing 11, assembled in the forend stock, is a slider channel for a slidable latch bolt 6, having a body shaped for sliding fore and aft the forend stock within the slider channel. Latch bolt 6 is slidably held in place by cover plate 9, which is fastened to the forend stock, shown in FIG. 3 fastened by three screws 10 which are fixed within complementary threaded holes of the forend stock 12, although other attachment schemes for cover plate 9 are not precluded by the design of the present invention. Cover plate 9 secures latch bolt 6 while allowing for a sliding action.

Latch bolt 6 is fitted within the slider channel. The body portion of latch bolt 6 slides relative to the forend stock, resting on lower flat side 6*c*, and having two vertical curved guides 6*a*, which may preferably be semi-circular guides. Latch bolt 6 includes at one of its ends an angled portion or bevel 6*b*, similar to the end of a retainer cylinder of a door lock bolt. At its other end, latch bolt 6 features a cylindrical post 6*d* to support a pressure spring 8. Pressure spring 8 provides a resilient force to latch bolt 6 in the sliding direction.

Crossing about the width of latch bolt 6 on its top side proximate its central area is a projection 6*g* having raised edges beyond the top side flat surface of latch bolt 6. The raised edges are available to mark the movement stoppers of latch bolt 6 within aperture 9*b* of cover plate 9. Preferably, projection 6*g* includes a straight-through orifice 6*f* preferably centering about the projection.

An actuating knob 7 is exposed on the underside of forend stock 12 to facilitate user handling of latch bolt 6, and is designed to be pressed by finger touch, or slidable in a direction parallel to the barrel axis through finger motion. The aforementioned actuator knob preferably includes a cylindrical post 7*b* that is attachable within the straight-through orifice 6*f* of latch bolt 6, and may afterwards be riveted at a rivet end 7*c* for the attachment of both parts. A riveted attachment scheme is presented; however, other attachment schemes are clearly not precluded provided the actuator knob 7 is secured to, and capable of supporting itself to, latch bolt 6, and capable of moving latch bolt 6.

Actuator knob 7 has a tapered end 7*a* adapted and formed in such a manner that lends itself to easy activation by a single finger, even if the user is wearing a glove. This area is accessible (once the gun is assembled) through the slot 12*c* (FIG. 4) at the bottom of forend stock 12. Slot 12*c* is a longitudinal channel or recess arranged such that a user can access the knob portion 7*a* of actuating knob 7 for manual handling of the latch bolt 6.

Tapered end 7*a* of actuator knob 7 is shaped as cylindrical portion of reducing radius as it extends away from forend stock 12. This shape is amenable to single finger contact. Other shapes may be employed for single finger activation, and the present invention is not limited to any resultant exposed surface for actuator knob 7 provided the exposed surface facilitates capture by a user's finger.

The assembly composed by latch bolt 6, the attached actuating knob 7, as well as compression spring 8, which after compression drives the latch bolt 6 forward towards the muzzle end of the firearm, is housed in the cavity installed in the forend 12*a* with the exception of the actuator knob finger grip 7*a*, which is exposed outside and underneath forend stock 12. Cover plate assembly 9 is fixed, preferably by the aforementioned three screws 10, which while penetrating through-holes 9*a*, tap in the forend stock into holes 12*d*.

Cover plate assembly 9 includes a rectangular hole or aperture 9*b* sufficiently wide enough to receive the raised edges of projection 6*g* of latch bolt 6. The movement of latch bolt 6 relative to cover plate assembly 9 is prohibited at each end of aperture 9*b* by the raised edges of projection 6*g*. This restraint on movement defines the forward and backward travel limits that latch bolt 6 can traverse in a direction parallel to the axial direction of the barrel.

At the rear or breech end of the forend stock is a dished, concave radial surface 12*e* that upon attachment of the forend stock 12 to the firearm is secured in proximity with the receiver end 13 of the firearm, which features an adjustment and complementary rotational protrusion 13*a* with approximately the same radius as concave radial area 12*e* but convex in curvature to form complementary adjoining surfaces. Essentially, the mating of receiver end 13 with the rear or breech end of the forend stock is configured for rotational attachment. This scheme facilitates a break-open action of the firearm, and ensures that the rotational motion during break-open is not restricted. The complementary mating surfaces work together to form a hinge to allow for the rotational opening and closing of the rifle action during loading and unloading.

On this same end, the forend stock features two flanges 12*f* which are complementary to the firearm's receiver 13 and together improve the alignment and fastening of the forend stock to the receiver.

Figure 5B:
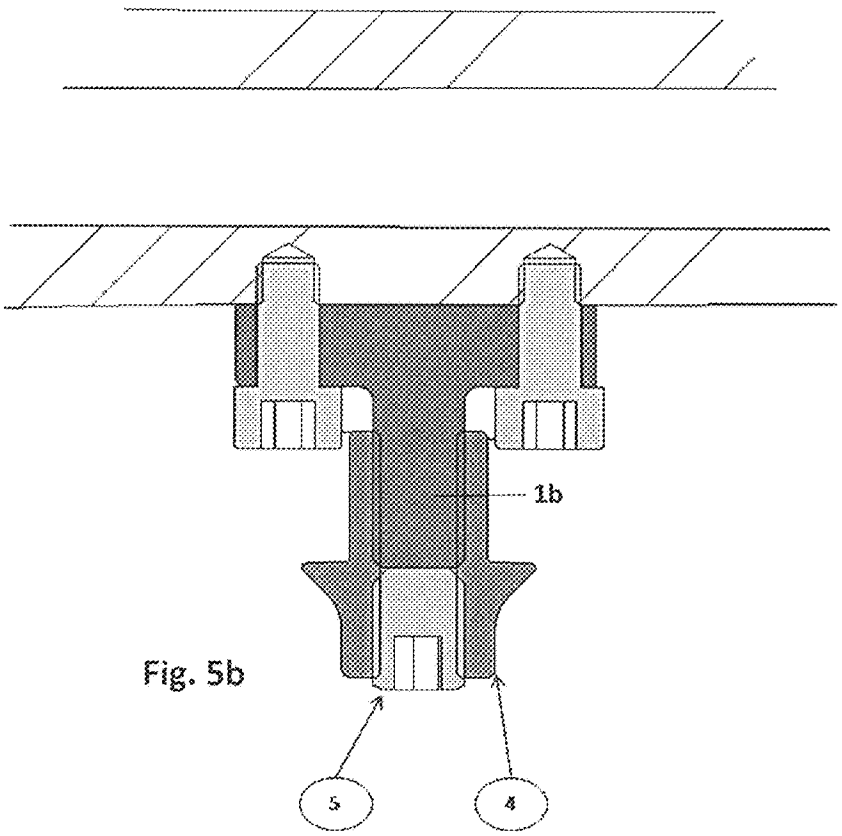
FIG. 5B depicts a cross-sectional view of FIG. 5A with the set screw 5 completely inserted within inner threaded area 4*a*.
Figure 5A:
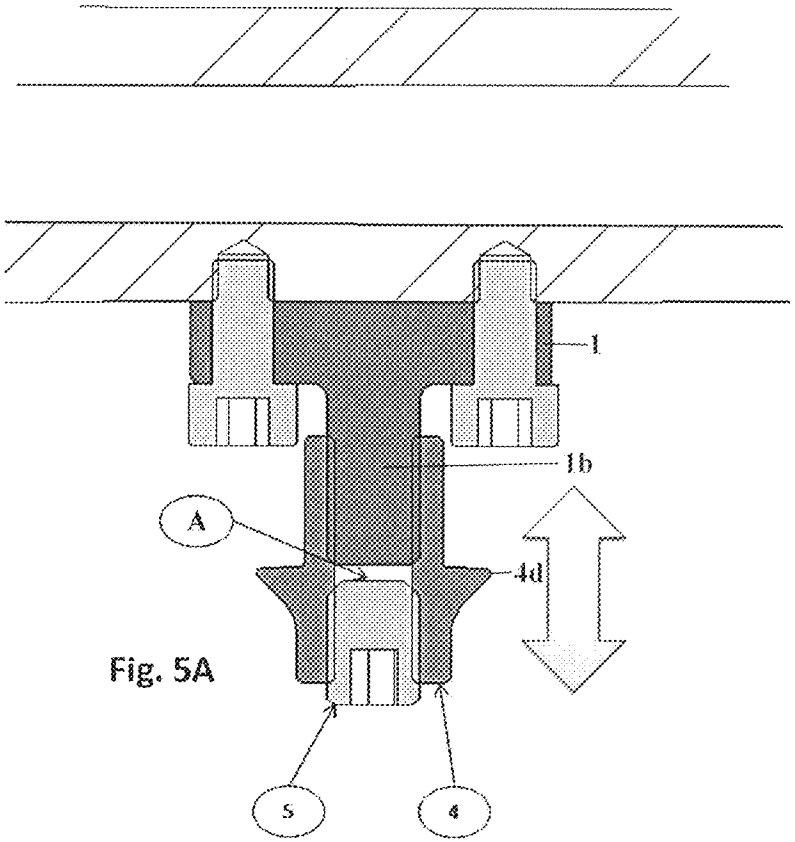
FIG. 5A is a cross-sectional, elevation view of the adjustment system of the present invention depicting a coupling part which can be raised and lowered by tightening or loosening so as to adapt it to a necessary measure to achieve a desired fit, and showing a gap between two threaded screws allowing for free movement of the parts.

FIG. 5A depicts a cross-sectional view of coupler 4 attached to barrel assembly 2. Set screw 5 is shown partially installed within inner threaded area 4*a* of coupler 4, exposing a gap "A" between the end of set screw 5 and the end of threaded rod 1*b* of housing lug 1. FIG. 5B depicts a cross-sectional view of FIG. 5A with the set screw 5 completely inserted within inner threaded area 4*a*.

Figure 6:
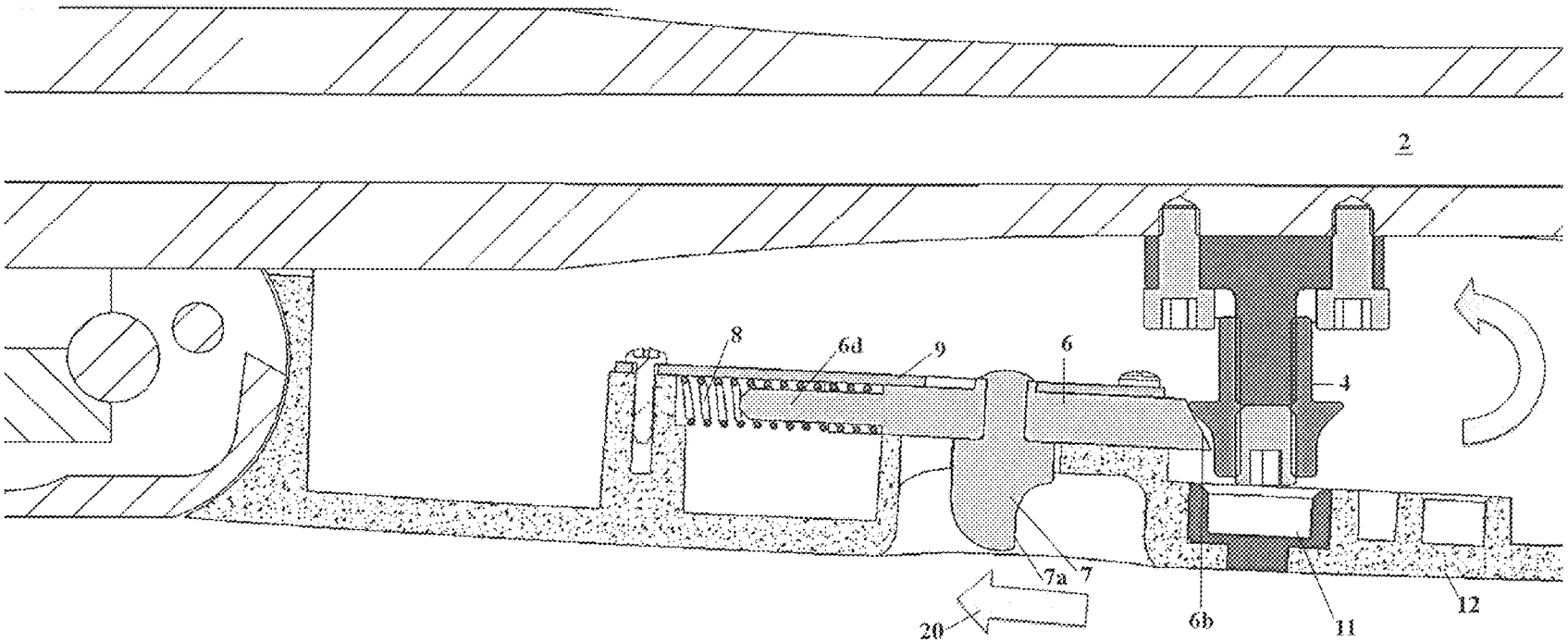
FIG. 6 depicts a cross-sectional view in the longitudinal direction (along the barrel axis) of the coupler attached to the barrel assembly at one end, and being rotationally moved relative to the forend stock away from the bushing, at the other end of the coupler.

FIG. 6 depicts a cross-sectional view in the longitudinal direction (along the barrel axis) of coupler 4 attached to barrel assembly 2 at one end, and being rotationally moved relative to forend stock 12 away from bushing 11, at the other end of coupler 4. This action depicts the removal of forend stock 12 from barrel assembly 2. Arrow 20 depicts the relative motion of knob 7 towards the breech end of the firearm, which in turn slides latch bolt 6 in the same direction, releasing coupler 4 and allowing the forend stock to rotate away from barrel assembly 2.

Figure 7:
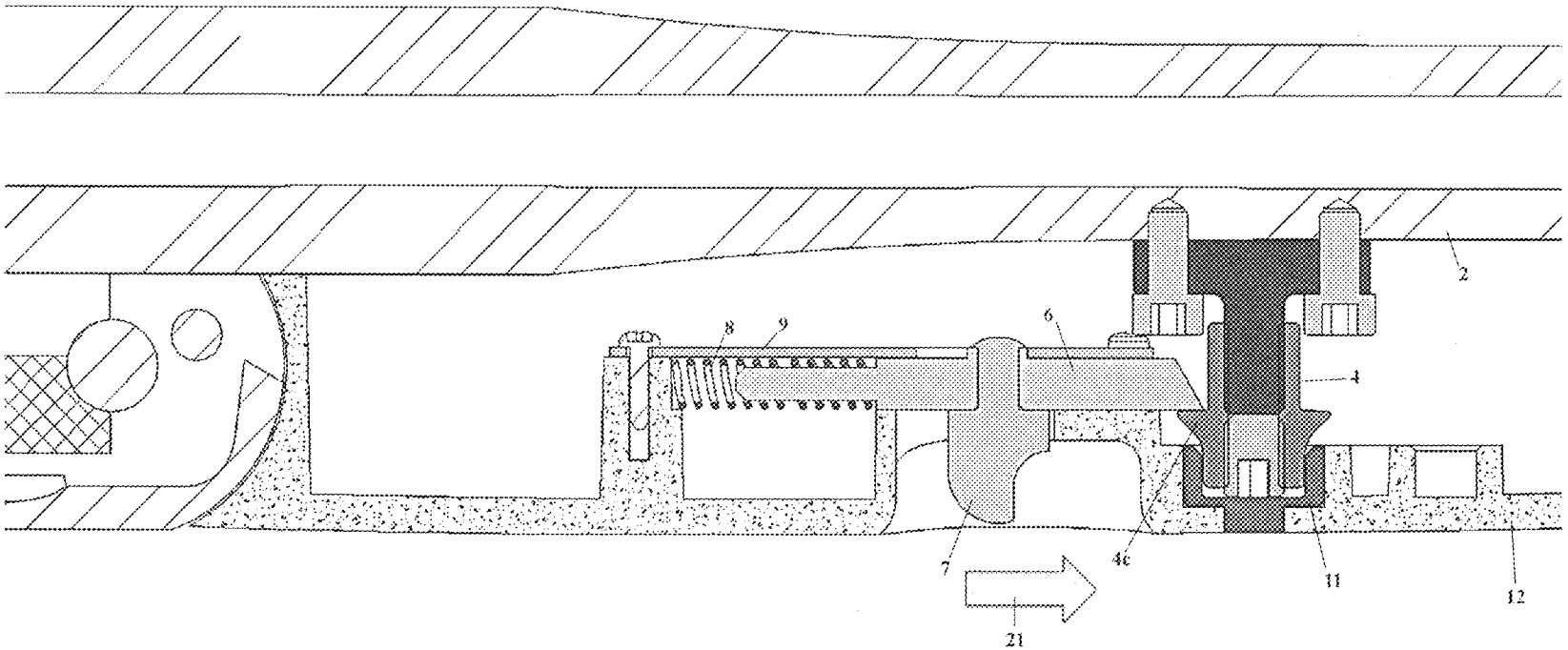
FIG. 7 depicts an attachment of the forend stock to the barrel assembly 2, showing the latch bolt under the resilient retraction force of a spring, forced against the coupler, and securing the extended disc portion of the coupler.

FIG. 7 depicts an attachment of forend stock 12 to barrel assembly 2. In this configuration, arrow 21 depicts the direction of latch bolt 6, under the resilient retraction force of spring 8, against coupler 4, securing extended disc portion 4*c*.

Figure 8:
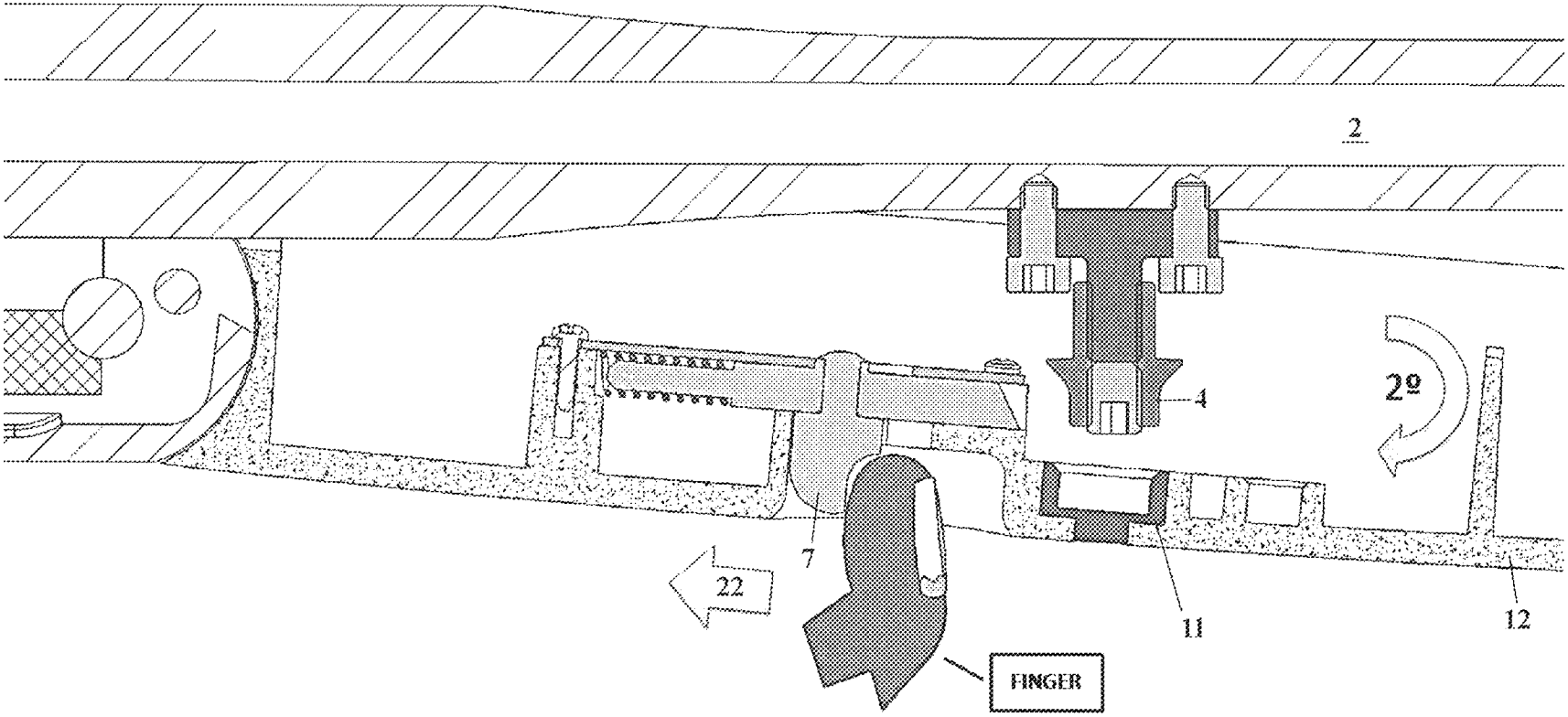
FIG. 8 depicts a releasing action of the forend stock from the barrel assembly, showing a user's finger pushing the knob in the breech end direction, which in turn moves the latch bolt in the same direction to release the coupler from the latch bolt.

FIG. 8 depicts a releasing action of the forend stock 12 from barrel assembly 2, showing a user's finger depressing knob 7 in the direction of arrow 22 (pushing knob 7 in the breech end direction), which in turn moves latch bolt 6 in the same direction to release coupler 4 from the latch bolt. Forend stock 12 is then able to rotate away from barrel assembly 2.

Figure 9:
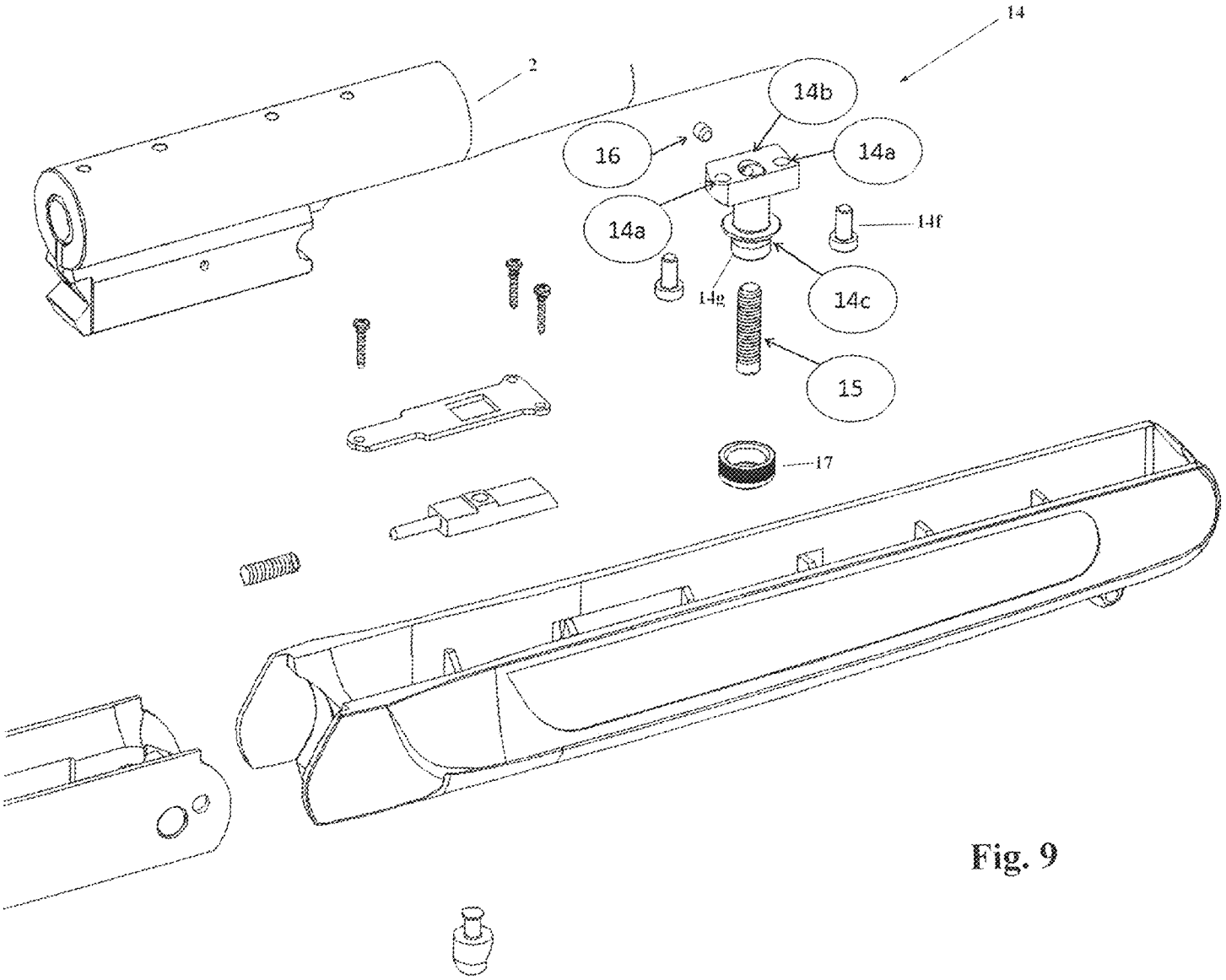
FIG. 9 depicts an exploded view of a second embodiment of the present invention, presenting an alternative housing lug and coupler configuration.

FIGS. 9-11 depict a second embodiment for the housing lug. FIG. 9 depicts an exploded view of a second embodiment of the present invention, presenting an alternative housing lug. In this embodiment, housing lug 14 is configured with a base 14*e* for attachment to the underside of barrel assembly 2. Base 14*e* is curved on its top surface having a concave surface with a radius for mating attachment to the curved barrel assembly 2. Through-holes 14*a* in base 14*e* receive securing bolts 14*f* for attachment to barrel assembly 2. Barrel assembly 2 includes complementary receiving threaded apertures (not shown) to receive securing bolts 14*f*. Housing lug 14 includes coupler 14*c* attached thereto. In at least one embodiment, coupler 14*c* is formed integral with base 14*e*; however, other attachment schemes, such as threaded attachment, snap-fit, friction fit, to name a few, may be employed to secure coupler 14*c* to base 14*e*.

Coupler 14*c* includes a threaded aperture 14*b* for receiving adjustment screw 15. Once installed within coupler 14*c* aperture, adjustment screw 15 is secured by set screw 16, which is inserted into a side wall of coupler base 14*b*.

At the coupler end opposite barrel assembly 2, there is a lower cylindrical area 14*g*, and between the two ends of coupler 14 is a finished area forming an extended disc portion 14*h* having an exposed edge. The extended disc portion 14*h* has a larger diameter than the cylindrical ends of coupler 4. In at least one embodiment, the extended disc portion 14*h* enjoys a transition radius that decreases with axial length as the extended portion extends away from barrel assembly 2.

Coupler 14 may be seated within bushing 17 in a similar manner as coupler 4 is seated within bushing 11.

Figure 10B:
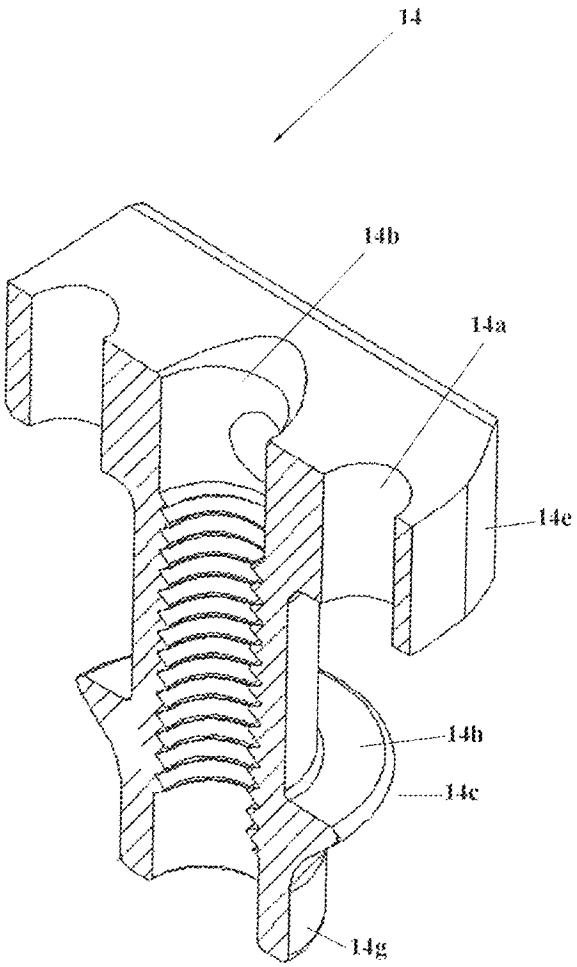
FIG. 10B depicts a perspective cross-sectional view of FIG. 10A.
Figure 10A:
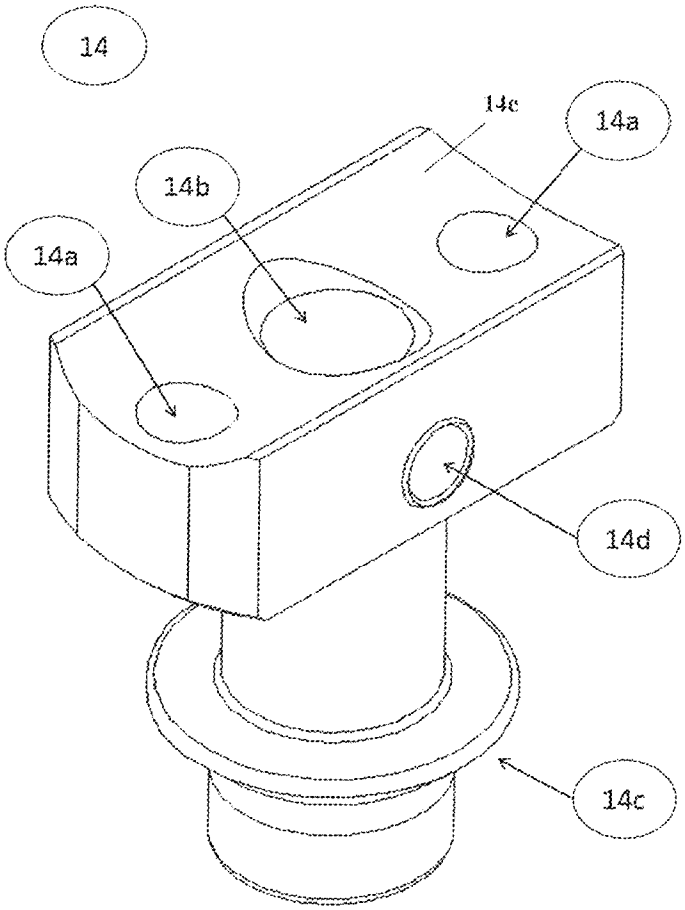
FIG. 10A depicts a perspective view of the second embodiment of the housing lug and coupler configuration.

FIG. 10A depicts a perspective view of the second embodiment of the housing lug and coupler configuration, showing coupler 14. FIG. 10B depicts a perspective cross-sectional view of FIG. 10A.

Figure 11B:
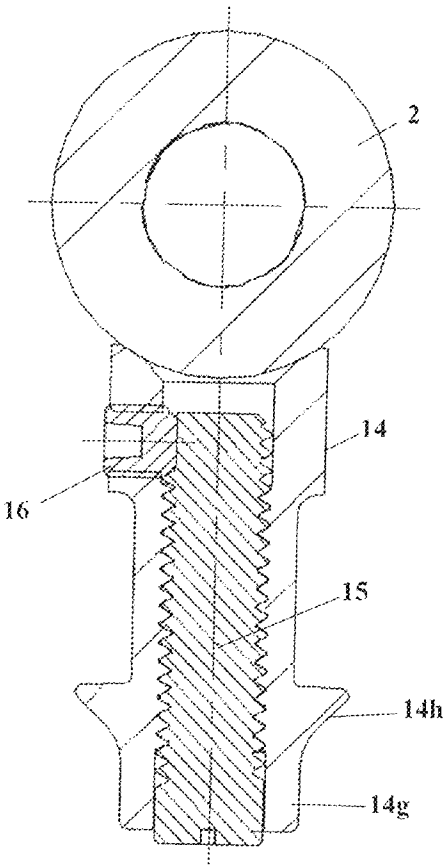
FIG. 11B depicts a cross-sectional side view of the second embodiment of the housing lug and coupler configuration attached to the barrel assembly.
Figure 11A:
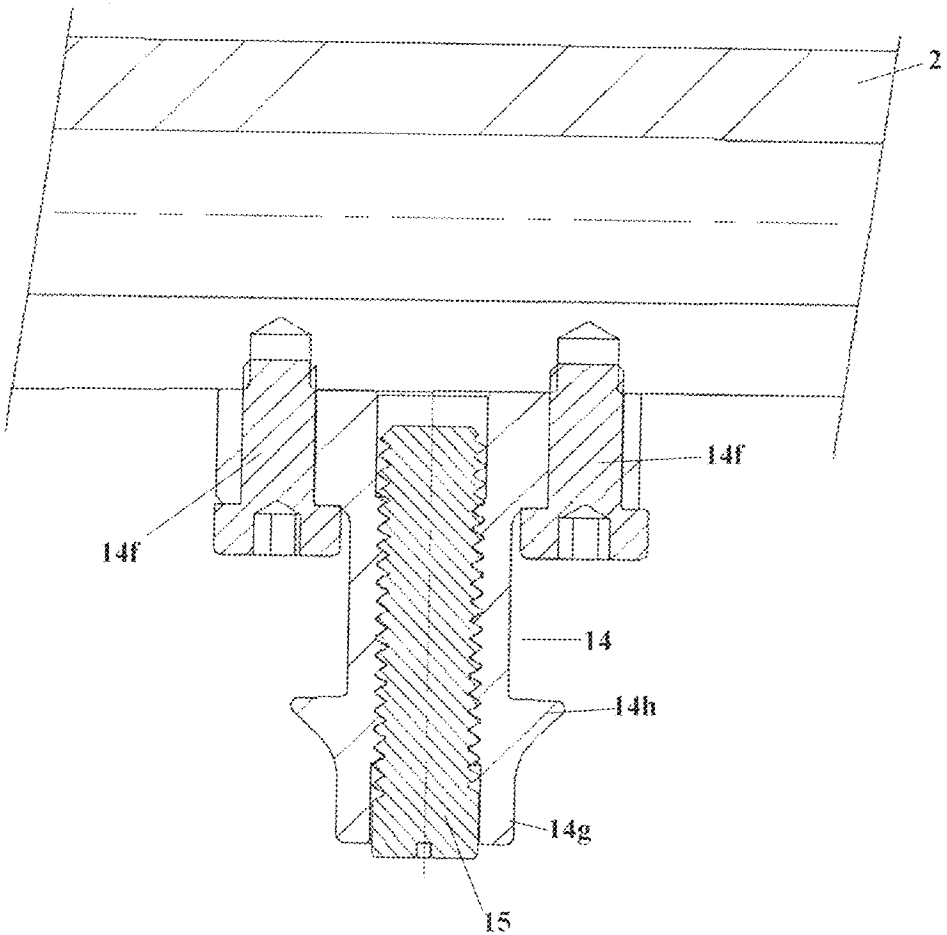
FIG. 11A depicts a cross-sectional view in the longitudinal direction (along the barrel axis) of the second embodiment of the housing lug and coupler configuration of FIG. 10A, attached to the barrel assembly.

FIG. 11A depicts a cross-sectional view in the longitudinal direction (along the barrel axis) of coupler 14 attached to barrel assembly 2. FIG. 11B depicts a cross-sectional side view of coupler 14 attached to barrel assembly 2.

A feature of the system described above allows for the forend stock 12 to be securely attached to the barrel assembly without the need of welded seams. Welds will typically generate strains and, in consequence, deformations and bending in the barrel itself, which ultimately could impact accuracy. To correct this bending and warping, expensive and time consuming straightening efforts are usually performed afterwards. Additionally, welds are contrary to clean processes and visually unattractive. Moreover, welds generally require further polishing.

If a repair of a welded piece is required, this adds great difficulty to the removal and repair process since, if it is not done in the original factory, the necessary tools to carry out this replacement with appropriate guarantees are generally not available.

In addition, having a forend stock being removably fixed instead of being welded, also includes the possibility of utilizing an adjustable coupler 4, 14 which is designed to vary in height. This feature, besides facilitating the assembly of the gun during its manufacturing process, ensures in the future that any user, who spots unwanted clearances caused by intensive use, should be able, by either loosening or tightening the coupler, to achieve a precise fit without clearances that may affect not only the accuracy but also the safety of the gun.

It is preferably desired for all the component parts of the invention's system to be replaceable and adjustable with the assistance of a simple Allen wrench and a standard screwdriver.

The forend stock recess 12*c* is shaped so that it can be easily operated on the actuator knob 7, even with gloves. In at least one embodiment, actuator knob 7 is exposed on the underside of forend stock 12 within the recess 12*c* so that the actuator knob 7 does not extend beyond the bottom surface of the forend stock. Apart from that, as it is inside this recess 12*c*, it becomes protected from unintended activations. As shown in FIG. 6, actuator knob 7 may include a curved portion 7*a* for seating a user's finger.

Operation—Firearm Assembly

Once the barrel is assembled on the rifle's receiver 13, the forend stock 12 is attached by fitting the concave radial area 12*e* in the complementary side of the receiver 13. The forend stock is then rotated until coupler 4, 14 is inserted into the housing's bushing 11, and more specifically, when the cylindrical adjustment area 4*b* and set screw 5 slide inside the bushing 11, or conversely, cylindrical area 14*g* and adjustment screw 15 slide inside bushing 11.

At this point, two contacts occur. On the one hand, the locking screw 5 reaches the bottom of the recess 11*b* of bushing 11, which defines the adjustment endpoint, and, on the other hand, the latch bolt 6 starts moving backwards compressing spring 8 when acted upon by radius area 4*d* against the angled tip of the locking bolt 6*b*. In similar fashion, coupler 14 performs the same function against latch bolt 6 upon insertion of the barrel assembly 2 into the forend stock 12.

At the end of this travel, extended disc portion 4*c* is below latch bolt 6 such that a resilient retraction force applied by spring 8 against latch bolt 6, pushes latch bolt 6 towards coupler 4, and a metallic click sound occurs that notifies the user that the part is fastened. Again, in a similar fashion, the embodiment of coupler 14 performs the same function.

To disassemble the forend stock, the actuator knob 7 is pressed to slide towards the breech end of the firearm by means of the user's finger, and simultaneously with this pressing, latch bolt 6 is moved to the breach end against the tension of spring 8, compressing spring 8. This action releases coupler 4, 14. The forend stock 12 is then released from the barrel. The forend stock is thereby removable.

Based on the implementation of the embodiments of the present invention, this sequence of operation is simple, natural, and essentially automated (finger motion on actuator knob 7 excepted); it needs no prior preparation or intervention of any mechanism and requires one or two seconds for its processing, both when assembling and disassembling.

Attachment System

One of the key aspects related with the accuracy of a rifle is the absence of clearances between its components and more precisely between the set of parts of the barrel, buttstock, forend stock, and action.

The present invention effects the quick attachment of these elements in the three possible axes in a secure, effective, and adjustable manner.

The movement of the forend stock in the direction parallel to the barrel axis (the forend lengthwise direction) is purposely limited as discussed below.

Using the first embodiment as an exemplary embodiment, coupler 4, attached to housing lug 1 via threaded rod 1*b*, forms an integral part of the barrel assembly that extends below the barrel and fits into bushing 11. These components attach in a manner that provides for minimum clearance; that is, just enough for them to fit into each other. The forend stock upon attachment is thus prohibited from longitudinal movements in the axial direction of the barrel, both axially forward towards the muzzle end and axially backwards towards the breech end. The motion backwards towards the breech end of the firearm is supplemented by the predetermined radius of the receiver 13*a* with the predetermined radius of the forend 12*e*.

In an alternative version, the housing lug having a threaded rod extending therefrom is replaced by a threaded rod secured directly to the barrel, either by threaded attachment or weld.

Movement of the forend stock in a crosswise direction is limited by the two side flanges 12*f* of the forend stock 12 that fit in receiver 13. The aforementioned adjustment between coupler 4 and bushing 11 promotes keeping the forend stock from moving in a crosswise direction.

When locking screw 5 reaches the bottom of bushing 11, there can be no further vertical movement, marking the maximum that these parts might be inserted one into the other, and thus forming the limit of the attachment of the forend stock against vertical movements towards the barrel. This configuration is adjustable by the user.

In the other direction, the latch bolt 6 locks coupler 4, preventing the forend stock from getting loose and involuntarily pivoting away from the barrel.

The attachment scheme of the present invention manages to secure the aforementioned parts against clearances and movements in any direction. For its assembly, one only needs to position the forend stock in place, and press it to lock in the fit. No further operation is necessary.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A firearm having an adjustable, releasable forend stock comprising:

a barrel assembly;

a retainer mechanism including a housing lug, said housing lug being threadably attached on a first side to a lower side of said barrel assembly, said housing lug having a threaded rod projecting on a second side opposite said first side, towards said forend stock;

a coupler threadably secured onto said housing lug threaded rod at a first end and having at a second end opposite said first end formed for insertion within a bushing fixed on said forend stock, said coupler including a cylindrical portion intermediate said coupler first and second ends, said cylindrical portion having an extended flange; and a latch bolt having a top surface and a beveled end, said latch bolt in slidable communication with said forend stock, and acted upon by a resilient component, such that said latch bolt secures said forend stock to said barrel assembly when in a locked position said latch bolt prohibits said coupler extended flange from movement.

2. The firearm of claim 1 wherein said housing lug includes a curved top surface for mating attachment to said barrel assembly.

3. The firearm of claim 1 including:

a cover plate secured to said forend stock, said cover plate having an aperture;

said latch bolt having a projection extending above said latch bolt top surface, and into said cover plate aperture, such that said cover plate aperture restricts slidable movement of said latch bolt.

4. The firearm of claim 1, wherein said cylindrical portion of said coupler includes a transition radius that decreases with axial length as said cylindrical portion extends towards said forend stock.

5. The firearm of claim 1, wherein said resilient component is at least partially contained by said latch bolt.

6. The firearm of claim 5, wherein said resilient component is a spring.

7. The firearm of claim 1, including an actuator knob connected at one end to said latch bolt, and extending at an opposite end from said forend stock underside, said actuator knob having a lower portion for promoting sliding action by a user.

8. The firearm of claim 7, wherein said actuator knob is attached to said latch bolt, such that upon sliding of said actuator knob towards said firearm breech end, said latch bolt is moved in a same direction, releasing said forend stock from said barrel assembly.

9. The firearm of claim 1, wherein said bushing includes a hollow end for receiving said coupler.

10. The firearm of claim 9, wherein said coupler includes a set screw for extending said coupler length and locking said coupler in place with respect to said housing lug.

11. The firearm of claim 10, wherein said set screw is receivable within said bushing hollow end.

12. The firearm of claim 1 wherein said latch bolt includes a back end shaped as a rod to serve as a guide to a compression spring that propels the latch bolt in a forward, muzzle end direction.

13. The firearm of claim 1 wherein said forend stock includes at a breech end a concave radial surface such that upon attachment with a complementary portion of a receiver end forms a rotational connection.

* * * * *